United States Patent [19]

Ban

[11] Patent Number: 4,526,374

[45] Date of Patent: Jul. 2, 1985

[54] GOLF PRACTICE DEVICE

[76] Inventor: Thomas E. Ban, 1156 Berwick La., South Euclid, Ohio 44121

[21] Appl. No.: 616,847

[22] Filed: Jun. 4, 1984

[51] Int. Cl.[3] ..... A63B 69/36

[52] U.S. Cl. ..... 273/194 R; 273/200 R

[58] Field of Search ..... 273/200 R, 186 A, 194 R, 273/162 E, 162 R, 26 E, 26 B; 242/54 R

[56] References Cited

U.S. PATENT DOCUMENTS

| | | | |
|---|---|---|---|
| 3,051,491 | 8/1962 | Cabot | 273/200 R |
| 3,065,563 | 11/1962 | Bascom | 273/200 R X |
| 3,820,795 | 6/1974 | Taylor | 273/186 A |
| 4,168,068 | 9/1979 | Grover | 273/186 A |

*Primary Examiner*—George J. Marlo
*Attorney, Agent, or Firm*—Harlan E. Hummer

[57] ABSTRACT

A golf practicing device is described as being a golf ball which is tethered to a casting-type fishing reel which is attached to a portable bracket which, in turn, is detachably mounted adjacent the handgrip on the shaft of a golf club, such as a chipping iron or putter. A pair of eyelets are provided on the bracket opposite and, in line, with the fishing reel to guide the line from the reel as it pays out from the reel upon stroking or hitting the ball with the club head. Thus, after putting or hitting the ball, the player only need rewind the reel to return the ball for another practice shot.

17 Claims, 6 Drawing Figures

GOLF PRACTICE DEVICE

BACKGROUND OF THE INVENTION

This invention relates to a golf practice device with a retrievable tethered ball and which is usable for practice under replicated golfing conditions.

Favorable golf practice requires close simulations to the actual techniques and equipment of the golfer. A perfected stroking procedure is an important technique as well as stance, foot positions relative to the ball, hand grip, etc. Use of "favorite" golf clubs is an important psychological factor in golf practice as well as the individual requirements associated with club handle, club shaft length, club heat shape, etc.

Performance of techniques such as putting, chipping and bump and run practices all involve stroking and retrieval of the ball. Retrieval by normal practice methods involves searching for a stroked ball, walking to it, picking it up and returning to the same or similar site for a repetitive stroke. This is a time consuming effort that does not enable close replication of practice strokes.

This invention consists of a light compact fixture which mounts on the shaft of a golf club and contains an assembled retrieval reel and line, ball holder - eyelet line guides, and a tethered ball. The fixture is readily removed and fastened to shafts of all golf clubs for practice purposes without marking or damaging the golfing equipment.

Use of this invention enables a golfer to use a favorite golf club, stroke a practice ball, retrieve it and replay it while maintaining identical foot positions, left hand grip and ball spot location. This invention also enables the retrieval to be rapid and less tiresome with respect to searching, walking and bending. Therefore less physical strain is expended in practice and more practice strokes can be performed within the golfers practice period.

DESCRIPTION OF THE PRIOR ART

Practice equipment for retrieving stroked golf balls is well known. U.S. Pat. Nos. 2,714,009, 3,168,312, 3,867,162, 3,735,934, 3,826,439, and 4,240,592 concern a large stationery ball retrieving apparatus using a reel and tethered ball. They are mechanized by a motor or foot pedal and are cumbersome and expensive. They have the capability of malfunctioning from snagged lines and their operation requires personal adjustments and periodic foot positional changes during practice. U.S. Pat. No. 3,065,563 relates to the use of a combination golf club and fishing rod wherein a series of eyelets are permanently fixed to the shaft and the terminal eyelet is adjacent to the club head. This has the advantage of using the club exclusively for practice, the components are not transferable to other golf clubs and the eyelet arrangement causes considerable line drag which affects golf simulation.

SUMMARY OF THE INVENTION

This invention overcomes the forementioned deficiencies for golf practice and contributes to close simulation of consistent golf exercises.

A further feature of this invention provides a low cost means of golf practice by use of a light weight and compact fixture mounted to a standard golf club. The unit is versatile to mount on any golf club and it enables short game practice inside homes or outside on yard surfaces. The same golf club can be used for practice and actual golf exercises.

A further feature of this invention enables the golfer to practice a series of replicate golf strokes using the same golf ball, the same golf club, the same left hand grip, the same stance, the same foot position, the same ball spot and the same direction to the golf hold. Such practice is valuable for perfecting specific putt shots or specific chip shots in a consistent manner.

A further feature of this invention enables the fixture to be very portable for carrying the assembled unit on a golf club or within a golf bag to practice areas because the ball is held within an eyelet holder which prevents the ball from wrapping around the golf club and breaking the tether line. This holder also contains the ball in event of inadvertent line release from the reel.

A further feature of this invention concerns the use of soft tubular clasps of elastomeric plastic material for gripping the fixture to the tapered shaft of a club without causing damage or marking thereon.

A further feature of this invention provides a compact fixture assembly wherein the angle subtended by the line at the eyelet between the reel mouth and the stroked ball approaches 180° and thereby mimimizes line drag at the eyelet.

A further feature of this invention provides versatility for operating the unit in either a reel under or reel on top mode by simply twisting the fixture around the shaft and securing the clasp. This enables golfers who may be intimidated by the sight of a reel to have it under the shaft and out of sight for stroking.

BRIEF DESCRIPTION OF THE DRAWING

The following description of the invention will be better understood by having reference to the accompanying drawing, wherein.

DETAILED DESCRIPTION OF THE DRAWING

Figure 1:
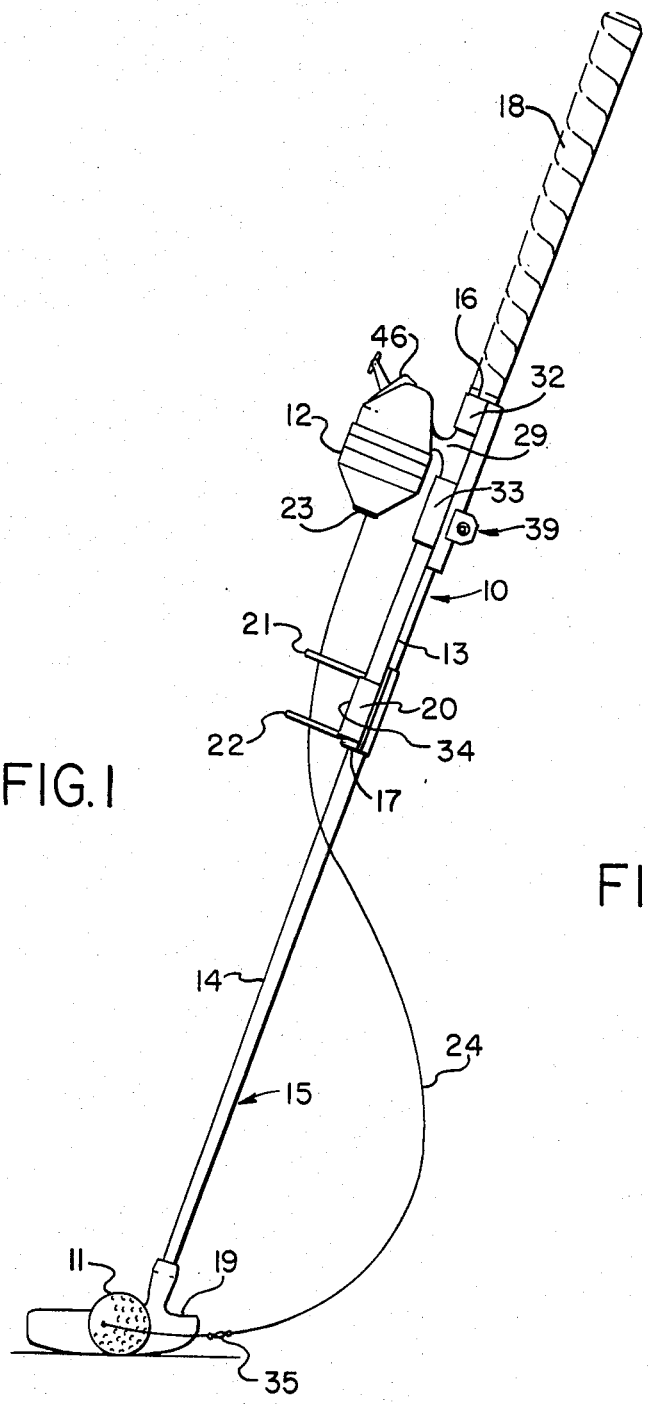
FIG. 1 is a side view of the invention which is mounted on a putting-type golf club with a tethered golf ball in position for putting.
Figure 2:
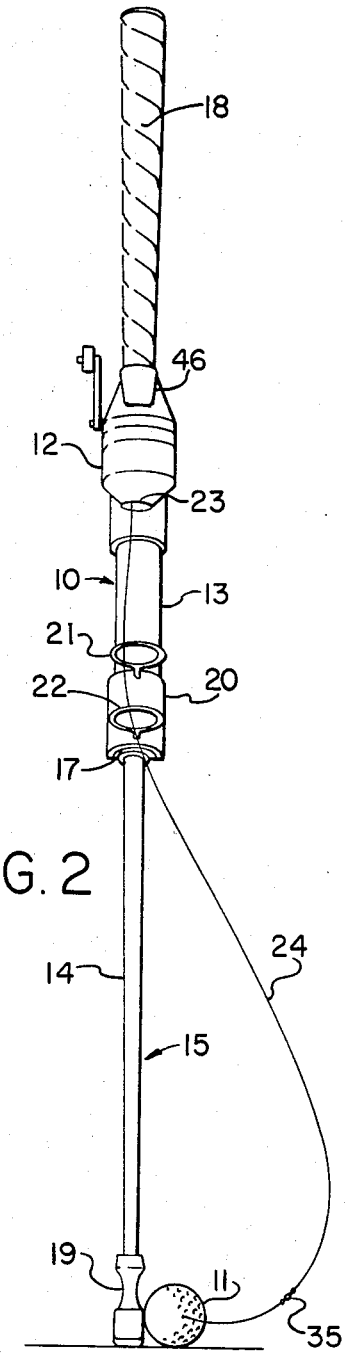
FIG. 2 is a front view of the putter and invention.

With general reference to the drawing for like parts, and particular reference to FIGS. 1 and 2, there is shown a golf practice device 10 which essentially comprises a golf ball 11 which is tethered to a small spin casting-type fishing reel 12 that is attached to a bracket 13 which is detachably mounted on the shaft 14 of a golf club 15, such as a chipping iron, or the putter shown.

Figure 3:
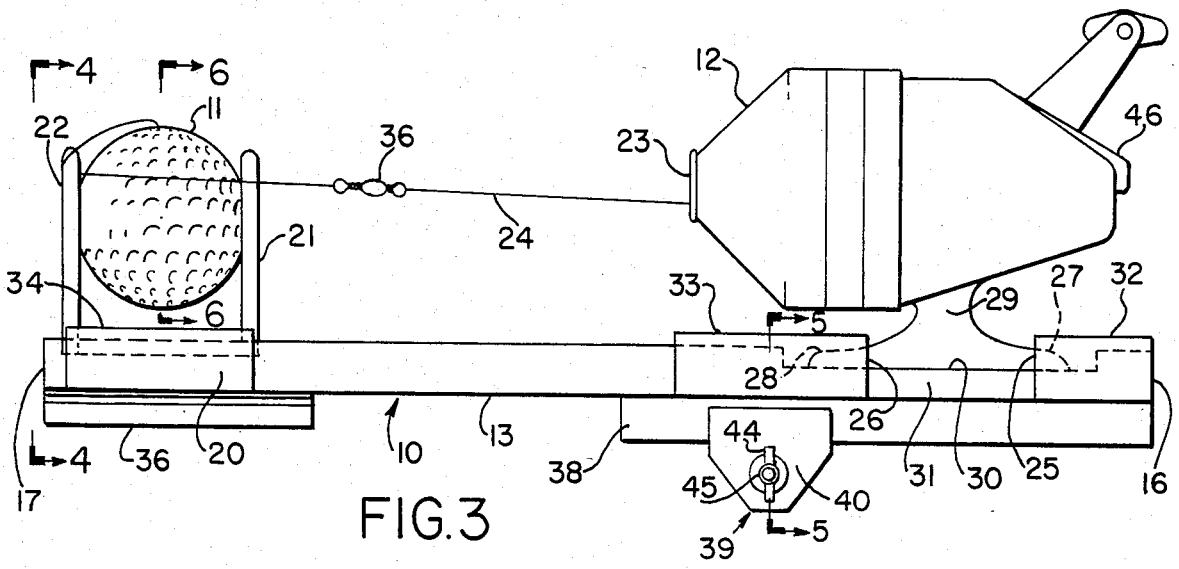
FIG. 3 is an enlarged side view of the invention.
Figure 4:
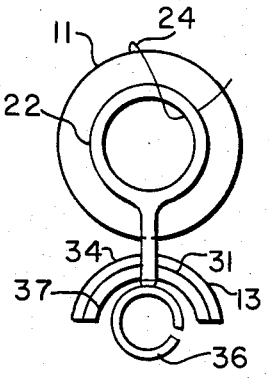
FIG. 4 is an end view of the invention from the line 4—4 of FIG. 3.
Figure 5:
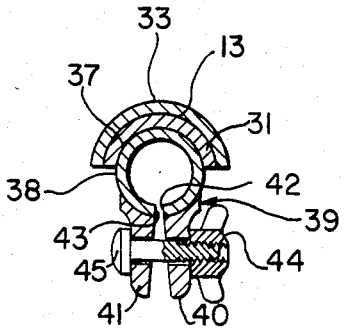
FIG. 5 is a section viewed from the line 5—5 of FIG. 3.

The bracket 13, as best seen in FIGS. 3–5, is elongated and extends longitudinally of the shaft 14. The bracket 13 has a parti-cylindrical cross-sectional configuration, and is composed of any suitable material, e.g. metal or plastic. The bracket 13 has a pair of opposing ends 16, 17, the rear end 16 being closer the hand grip or handle 18 of the golf club 15, and the front end 17 being closer the club head 19. The rear end 16 of the bracket 13 is adapted to hold the fishing reel 12, and the front end 17 of the bracket 13 is designed to hold an eyelet assembly 20 which includes two, parallel, metal eyelets 21, 22 that are axially aligned with the conventional front opening 23 in the fishing reel 12.

Figure 6:
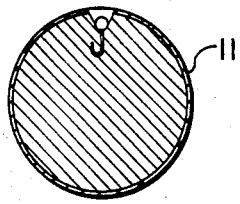
FIG. 6 is a section viewed from the line 6—6 of FIG. 3.

Any appropriate high strength line 24, such as monofilament nylon fishing line, is reeled on the fishing reel 12 and extends from the front opening 23 for subsequent passage through the twin eyelets 21, 22. The free end of the line 24 is secured to the golf ball 11 by any suitable means, e.g. a countersunk threaded screw or an embedded J-hook as shown in FIG. 6.

The rear end 16 of the bracket 13, like a conventional fishing rod, is provided with a pair of spaced, aligned slots 25, 26 which are designed to receive and hold therein, the wings or outstanding flanges 27, 28 of the base 29 of the fishing reel 12. The slots 25, 26 are formed between a longitudinally extending recess 30 in the body 31 of the bracket 13, and a pair of overlapping, parti-cylindrical holders 32, 33, one of which holders can be detachably mounted on the bracket 13 to permit removal and replacement of a defective reel 12.

The eyelet assembly 20 utilizes a third, parti-cylindrical holder 34 to which the twin eyelets 21, 22 are firmly attached, and which is firmly anchored adjacent the front end 17 of the bracket 13. The eyelets 21, 22 are spaced apart a distance which is less than the overall diameter of the golf ball 11. Further, the eyelets 21, 22 are sufficiently large to snugly grip opposing sides of the ball, when the eyelets are sprung apart slightly to receive the ball. Thus, the twin eyelets 21, 22 serve a twofold purpose, i.e. to guide the line 24 as it pays out from the reel 12, and to provide a storage space for the golf ball 11 when the device 10 is not in use.

It has been found that the terminal eyelet 22, or the eyelet closest the club head 19, should not be close to the club head 19, but spaced therefrom a distance which is at least one-half, and preferably two-thirds, the length of the shaft 14 between the club head 19 and grip 18 to minimize drag of the line on the ball as the line pays out from the eyelet 22. Otherwise, the intended pathway which the golf ball 11 travels and the resistance to travel, especially during putting, can be adversely affected. A putted ball will rotate and twist the line 24 to cause the ball to veer from a normally traveled pathway. The problem of twisting line is overcome by placing a conventional, metal swiveling device 35 in the line 24 adjacent to the golf ball 11. Thus, the line from the reel to the swivel and the line from the swivel to the ball are free to rotate in relation to each other.

Any suitable mechanism can be used for mounting the bracket 13 on the club shaft 14, providing the mounting holds the bracket 13 firmly in position and does not mar or damage the club shaft 14. It has been discovered that a relatively soft, resilient, flexible polyvinyl chloride (PVC) has excellent gripping characteristics, especially in relation to highly polished chromed surfaces which most club shafts 14 have. With this in mind, a split piece of PVC tubing 36 is secured to the curved underside 37 of the bracket 13 adjacent the front end 17, as best seen in FIG. 4. The inside diameter of the PVC tubing should be slightly less than the outside diameter of the club shaft 14, e.g. one-eighth inches, for better gripping action. A similar, but longer piece of split PVC tubing 38 is bonded to the underside 37 of the bracket 13 adjacent the rear end 16, as best seen in FIG. 5. In essence, the pieces of PVC tubing 36, 38 act as two spaced clasps for gripping the club shaft 14. Such clasps 36, 38 are sufficient to hold the bracket in place, providing the golf club 15 is used to tap or mildly stroke the ball. Otherwise, greater clamping of the bracket 13 is required. This is accomplished by providing the rear PVC clasp 38 with an additional clamp 39 to tighten the PVC tubing 38 around the club shaft 14.

The clamp 39, in this case, comprises two halves or sections 40, 41 which are secured to the adjacent split ends 42, 43 of the PVC tubing 38. Any appropriate wing nut 44 and bolt 45 arrangement, for example, can be used to draw the clamp halves 40, 41 together to tighten the PVC tubing 38 around the club shaft 14 and prevent any slippage of the bracket 13 on the club shaft 14. Also, two semi-circular hose clamps can be bolted around the bracket 13 and upper clasp 38. It can be appreciated that, in some instances, it may be better to provide one continuous piece of split PVC tubing, rather than two pieces, especially if the bracket 13 is shorter and more compact.

For practice operations the assembled device 10 is mounted on a golf club adjacent the handgrip by initially prying the lower PVC clamp 36 open and enclosing the lower portion of the club shaft within it. The upper PVC clasp 38 is similarly attached to the upper portion of the shaft adjacent the handgrip. The entire device is then twisted on the shaft to line up with the top centerline of the club shaft, as illustrated in FIGS. 1 and 2. Alternately, the device can be twisted 180 degrees and mounted along the bottom centerline of the shaft. After the desired mounting position is attained, the bracket 13 is secured by tightening the nut and bolt of the clamp to the desired extent of gripping force.

Golf practice is carried out by springing the eyelets 21 and 22 apart slightly to remove the ball for placement on the ground, or some other surface. Simultaneously, the line release button 46 on the reel 12 is depressed, whereby the spin casting feature of the reel allows free dispensing of the line through the eyelets 21, 22 to the tethered ball 11. The ball is then hit by the golf club using a normal golf stroke such as used for putting. The ball is retrieved by the golfer for a repeat practice stroke by winding the reel and repositioning the ball.

Fixed foot positions with respect to a desired target can be established by placing the ball in front, for instance, of a coin on the putting surface and reeling the ball in to about the vicinity of the club head. The club is then lifted and slowly lowered to accurately place the ball in front of the coin. The line release button 46 is then depressed for dispensing of line and the golfers feet and body are positioned for putting (generally eyes directly above the ball, knees and waist slightly bent and feet in a fixed position with respect to the hold and the ball). The left and right hand are gripped on the handle of the club and the ball is stroked by the club generally through use of the upper extremities of the body functioning as a single unit. The ball is recovered by maintaining foot positions and left hand grip while reeling back the ball with the right hand. If the ball becomes snagged on an obstruction, it can generally be freed by jerking the club outwardly slightly while reeling in the ball. The golf ball is then repositioned as described previously by the left hand controlling the club and the right hand operating the reel.

Thus, there has been described a unique, portable device for practicing different golf strokes in a limited area without having to chase the ball.

What is claimed is:

1. A portable golf practicing device, comprising:

(a) an elongated bracket for positioning longitudinally of the shaft of a golf club, the bracket having a pair of longitudinally spaced opposing ends;

(b) at least one eyelet carried by the bracket adjacent the opposing end of the bracket closest the head of the club when the bracket is positioned on the club shaft;

(c) a reel having a continuous line reeled thereon and payable therefrom, the reel being carried by the bracket adjacent the other opposing end of the bracket closest the handgrip of the club when the bracket is positioned on the club shaft, the reel and eyelet being in general alignment longitudinally of the bracket, so that the line will extend in a relatively straight line through the eyelet;

(d) a hitable ball secured to the free end of the line extending beyond the eyelet; and (e) means for detachably mounting the bracket longitudinally of the shaft of a golf club next to the handgrip of the club, the length of the bracket being such that the terminal eyelet, closest the club head, is spaced from the club head a distance which is at least one-half the length of the shaft between the club head and handgrip, when the bracket is mounted on the shaft next to the handgrip.

2. The device of claim 1, wherein the bracket mounting means includes at least one strip of flexible plastic material carried by the bracket for at least partial wrapping around the club shaft, and means for tightening the strip around the shaft in compressive engagement therewith.

3. The device of claim 2, which includes a swivel in the line adjacent the ball to permit relative rotation between line extending from the reel and line attached to the ball.

4. The device of claim 3, which includes a second eyelet of the same size in closely spaced axial alignment with the other eyelet between the other eyelet and reel, the eyelets being spaced and sized so that the ball can be placed and held therebetween.

5. The device of claim 4, wherein the ball is a golf ball, and the line is fishing line, and the reel is a spin casting-type fishing reel.

6. The device of claim 5, wherein the plastic is a relatively soft polyvinyl choride.

7. The device of claim 6, wherein the strip of polyvinyl chloride is a split tube, and the strip tightening means includes a clamp having two sections which are secured to the adjacent split ends of the tube, and means for drawing the sections and attached ends together to tighten the polyvinyl chloride around the club shaft.

8. The device of claim 7, which includes means for detachably mounting the reel on the bracket.

9. The device of claim 7, which includes two split polyvinyl tubes, one being at either end of the bracket, and the clamp cooperates with the split tube adjacent the end of the bracket closest the handgrip.

10. The device of claim 9, wherein the bracket is composed of material of the group of metal and plastic, and the eyelets are metal.

11. The device of claim 10, wherein the reel mounting means includes a pair of longitudinally spaced slots for receiving opposing, outwardly extending flanges on the base of the reel, and means for holding the flanges securely in the slots.

12. The device of claim 11, wherein the reel is a casting-type fishing reel which has a depressable button for allowing line to pay out from the reel.

13. The device of claim 12, wherein the bracket has a parti-cylindrical cross-sectional configuration, and the polyvinyl chloride tubing is secured to the curved underside of the bracket closest the club shaft.

14. A portable golf practicing device, comprising:

(a) an elongated bracket for positioning longitudinally of the shaft of a golf club, the bracket having a pair of longitudinally spaced opposing ends and a parti-cylindrical cross-sectional configuration;

(b) a spin casting-type fishing reel secured to the bracket adjacent the opposing end of the bracket farthest from the head of the club, when the bracket is mounted on the shaft of a golf club, the reel having a continuous length of fishing line reeled thereon and an opening through which the line pays out from the reel;

(c) a pair of eyelets secured to the bracket adjacent the other of the opposing ends in longitudinal alignment with the opening in the reel, the eyelets being in axial alignment and being longitudinally spaced and sized to frictionally hold a golf ball between them, the line passing successively through the eyelets;

(d) a golf ball secured to the free end of the line beyond the eyelets, so that the ball is tethered to the reel via the line;

(e) means for securing the reel to the bracket, including means for holding outwardly extending flanges of the base of the reel firmly in a pair of aligned slots which are formed in the bracket; and (f) means for detachably mounting the bracket on a shaft of a golf club, including, (i) a parti-cylindrical resilient clasp which, at least, partially surrounds the shaft, and (ii) means for tightening the clasp around the shaft in compressive engagement with the shaft; and (g) a swivel in the line adjacent the ball to allow the ball to rotate in relation to the line between the swivel and reel, so that the line will not become twisted and adversely affect the movement of the ball.

15. The device of claim 14, wherein the clasp is at least one piece of longitudinally split polyvinyl chloride tubing which has a pair of opposing, longitudinal marginal edges, and the clasp tightening means includes a clamp for drawing the marginal edges of the tubing towards each other.

16. The device of claim 15, wherein the bracket is composed of material of the group of metal and plastic, and the eyelets are composed of metal, and the bracket is such that when it is mounted on a conventional golf club just below the handgrip, the terminal eyelet, closest the club head, will be spaced from the club head a distance which is not less than about one-half the length of the shaft between the club head and handgrip.

17. The device of claim 16, wherein the clasp includes a pair of similar clasps which are spaced longitudinally of the bracket.

* * * * *